United States Patent [19]

Moxon et al.

[11] Patent Number: 4,964,329

[45] Date of Patent: Oct. 23, 1990

[54] SOUND ATTENUATION WITH FOAM

[75] Inventors: Neville T. Moxon; Alstair C. Torrance, both of New South Wales; Stephen B. Richardson, Blackall's Park, all of Australia

[73] Assignee: Broken Hill Proprietary Co., Ltd., Melbourne, Australia

[21] Appl. No.: 123,633

[22] Filed: Nov. 23, 1987

[30] Foreign Application Priority Data

Nov. 21, 1986 [AU] Australia ..... PH9109/86

[51] Int. Cl.[5] ..... F42B 33/00; F42B 1/00; C06B 21/00

[52] U.S. Cl. ..... 86/50; 89/1.13; 89/36.02; 89/36.17; 102/305; 86/1.1

[58] Field of Search ..... 86/50; 102/303, 305, 102/316; 252/62; 109/49.5, 26; 89/1.13, 36.02, 36.11, 36.17; 150/52 H

[56] References Cited

U.S. PATENT DOCUMENTS

| | | | |
|---|---|---|---|
| 4,353,817 | 10/1982 | Nakae et al. | 524/232 |
| 4,432,285 | 2/1984 | Boyars et al. | 86/50 |
| 4,543,872 | 10/1985 | Graham et al. | 86/50 |
| 4,569,950 | 2/1986 | Hoshi et al. | 521/88 |
| 4,589,341 | 5/1986 | Clark et al. | 102/303 |
| 4,621,559 | 11/1986 | Ohlson | 86/50 |

FOREIGN PATENT DOCUMENTS

| | | |
|---|---|---|
| 0150112 | 7/1985 | European Pat. Off. . |
| 1237193 | 6/1971 | United Kingdom . |
| 1498472 | 1/1978 | United Kingdom . |
| 2116227 | 9/1983 | United Kingdom . |
| 8201007 | 7/1981 | World Int. Prop. O. . |

*Primary Examiner*—Howard J. Locker
*Attorney, Agent, or Firm*—Armstrong, Nikaido, Marmelstein, Kubovcik & Murray

[57] ABSTRACT

Method for reducing the peak overpressure of an explosion by disposing in the path of the explosion a barrier of an aqueous foam containing dispersion particulates predominately smaller than 200 mesh.

8 Claims, 1 Drawing Sheet

SOUND ATTENUATION WITH FOAM

FIELD OF THE INVENTION

Figure 1:
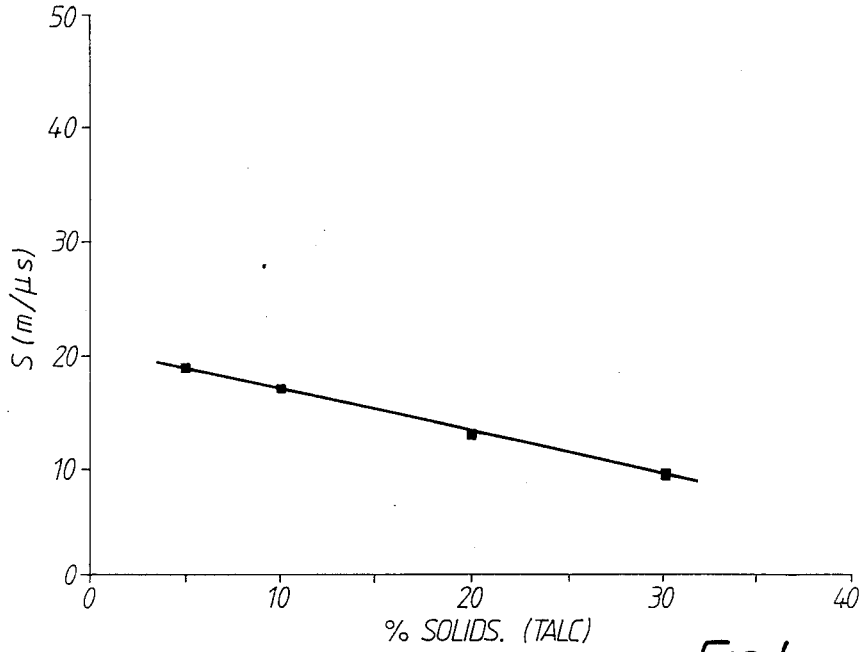

This invention relates to foamable compositions and in particular is concerned with the sound attenuation properties, especially the shock wave attenuation properties, of liquid foams generated from such compositions.

BACKGROUND ART

Explosives are used in open cut mines to facilitate either overburden removal or the mining of the final product. In a number of instances, the shock wave produced by a detonating explosive is too strong, resulting in overblasting and excess damage to the surrounding strata. This can lead to problems in final limits blasting, in blasting in weak or highly jointed material and in production blasting in soft rock. Cracks from blasting have been detected as far as 50 meters behind the borehole in the high wall and final limit areas of a mine situated in weak geological structures. Large pockets of fine material have also been observed after blasting in a coal seam. Both these situations indicated that the explosive used was too powerful for the material being mined. In particular, the peak shock energy of the explosive has been too great, resulting in the observed damage.

It is known to employ foams for sound insulation and attenuation purposes generally. One specific application is the absorption of shock waves from explosive devices such as car bombs and parcel bombs. The practice, as an alternative to disarming e.g., by a remotely controlled robot, is to envelop the bomb in foam at detonation. This technique has met with some success in reducing the air overblast produced by an explosive and thus reducing explosive damage to structures in the vicinity of parcel and car bombs. The tests carried out by the Defense Departments have been fairly rudimentary in nature, with few measurements being taken except for peak noise levels in the far field. Published papers have, e.g., examined the use of foams, especially acqueous foams, in the reduction of blast noise, demolition noise, gun blast noise levels, and the blast produced by a bomb in the trunk of a small car. The use of foam to provide blast attenuation in mining has not been canvassed.

A number of research programs have been conducted to ascertain the nature of the processes by which foams and other heterogeneous materials dissipate energy. Several such processes have been identified. Heat conduction losses result from the conduction of thermal energy between the liquid and bubbles and cause a phase difference between the pressure in the bubbles and the external pressure. Multiple reflections from bubble surfaces within the foam cause the energy to disperse. Energy dissipation also results from a viscous loss mechanism involving the friction of individual bubbles during oscillations, and exchanges of molecular energy that can lead to absorption of sound include the conversion of kinetic energy into stored protential energy (e.g., in structural re-arrangements), rotational/vibrational energy, or energies of association and dissociation. The multiple reflection mechanism has been found to become more prevalent as the foam becomes drier. The relative importance of each of these processes in the attenuation of sound, including shock waves, by foam has not been clearly established.

SUMMARY OF THE INVENTION

In accordance with the present invention, it has been appreciated that the viscous loss mechanism is a principal cause of sound attenuation and that the attenuation characteristics of liquid foam can be substantially enhanced by providing a particulate dispersion in the foam.

The invention accordingly provides a composition comprising a mixture of foamable liquid and a particulate additive selected to be supported as a dispersion in foam when generated from said liquid, which dispersion is effective to enhance the sound attenuation capability of the foam.

The invention further provides a liquid foam containing a particulate dispersion effective to enhance the sound attenuation capability of the foam.

Advantageously, the particulate dispersion is effective to enhance the shock wave attenuation capability of the foam.

The foamable liquid is preferably of a kind for which the expansion ratio of the foam further increases after initial generation, by virtue of drainage of liquid from the foam. It is surprisingly found that the presence of the particulate dispersion in such foams causes enhancement of sound attenuation in the foam with increasing expansion ratio, that is as the foam dries out, the converse of the situation in the absence of the dispersion. The expansion ratio ER, as referred to herein, is define as follows:

$$ER = \frac{\text{Volume of Gas in Foam}}{\text{Volume of Liquid in Foam}}$$

The particles of the dispersion are preferably of size smaller than 200 mesh (76 micron). It is thought that larger particles may have a destabilishing effect on many liquid foams.

The invention is also directed to a method of reducing the peak overpressure produced by an explosive, comprising disposing adjacent the explosive, or otherwise in the path of the shock wave generated by the explosive, a barrier of a liquid foam containing a particulate dispersion effective to enhance the shock wave attenuation capability of the foam.

Still further proved by the invention is a method of mining utilizing an explosive to blast a geological structure, wherein the peak overpressure produced by the explosive is reduced by disposing adjacent the explosive, or otherwise in the path of the shock wave generated by the explosive, a barrier of a liquid foam containing a particulate dispersion effective to enhance the shock wave attenuation capability of the foam.

COMPARATIVE EXAMPLE 1

A simple prior art foam was produced from a foamable composition consisting of 6% by volume EXPANDOL (Trade Mark) solution. EXPANDOL is a commonly used firefighting foam reagent manufactured by Angus Armour Ltd. of the United Kingdom. Two types of foam were produced. Type I foams were produced by passing air through a glass frit into the solution of foam reagent at a flow ratio of two liters per minute. The bubbles produced were approximately 8 mm in diameter and the foam had an expansion ratio (ER) of approximately 20. Type II foams were produced by entraining air in a solution of foam reagent using a mechanical blender. This gave a foam with a bubble size of approximately 0.5 mm.

Foams in accordance with the invention, hereinafter referred to as the particulate foams, were also produced by adding respective known masses of talc, maximum particle diameter 32 micron, to a 6% by volume EXPANDOL solution, and mechanically blending this composition as before with the Type II foam. The talc formed a particulate dispersion in each resultant foam, with an average bubble diameter of about 0.5 mm. The liquid component drained slowly, increasing the expansion ratio from an initial 40 to 200 in 120 minutes.

For the purposes of comparison four other foams were utilised, Viz PALMOLIVE Rapid Shave (Trade Mark) a liquid foam straight from the container, and three solid foams: a polyurethane foam, a polystyrene foam obtained in the form of 8 mm beads, and vermiculite.

For the purpose of ascertaining and comparing the shock wave attenuation capability of these foams, a sequence of experiments was carried out in a blast chamber utilizing each of the several foams in turn. For each experiment, a thin walled plastic cylindrical container, of known diameter, was positioned in the center of the chamber. The explosive (of known weight), detonator and an attached optical fibre trigger were placed in the center of the container so that the middle of the explosive was at the same height from the floor of the chamber as an array of pressure transducers at predetermined distances from the chamber centre. The container was filled with foam and the explosive detonated. The overpressure experienced by the transducers was captured and analysed.

The explosive was Detaprime WG (Trade Mark), which had been shown to be the most reproducible explosive. Detaprime WG is a detonator sensitive primer manufactured by Du Pont from an extruded mixture of PETN and an elastomer binder. It is supplied in the form of a 76 mm long tube with a 7.1 mm axial hole through the center and has the appearance and texture of rubber. The average weight of Detaprime WG was found to be 19.7 g, but it can be readily subdivided into any size or weight. The manufacturer quoted a detonation velocity of 7300 meters per second, a density of 1.5 g/cm$^3$ and a detonation pressure of 200 kbar. Normal No. 8 instantaneous electric blasting caps were used to detonate the explosives.

A typical set of results is set out in Table 1. It will be seen that the particulate foam clearly has the optimum shock wave attenuation capability.

TABLE 1

PERFORMANCE OF SHOCK WAVE ATTENUATING FOAM MATERIALS

| Material | Pressure reduction for 8 mm foam depth (%) | Pressure reduction for 24 mm foam (%) |
|---|---|---|
| Particulate | 72 | 78 |
| Type II Foam | 67 | 73 |
| Vermiculite | 42 | 61 |
| Shaving Foam | 37 | 56 |
| Type I Foam | 33 | 45 |
| Polyurethane Foam | 30 | 39 |
| Polystyrene Beads | — | 36 |

NOTE: All measurements were made at a distance of 0.31 meters.

COMPARATIVE EXAMPLE 2

In another series of experiments, the respective foams employed in Example 1 were generated or held in cubic plastic tanks, for example each having a 300 mm. side. A 100 mm. diameter piezoelectric loudspeaker was positioned centrally of one side of the tank, and an electric condenser microphone was suspended in the body of the foam. An electrical impulse was generated by a Philips Mode PM 5700 or similar pulse generator and passed to the loudspeaker. The signal detected by the microphone was amplified and stored for analysis in a digital wave form analyser, with a maximum sampling rate of 37.5 ns per data point. The expansion ratio of the foam was continually monitored using a sample of the foam in a separate container.

An acoustic wave was produced by the speaker and propagated through the medium of interest as a stress wave. It has been shown that it is possible to asses the way different materials attenuate a stress wave using pulsed rise time ($\tau$) techniques. This technique requires detailed information of the onset of the pulse only, rather than for the whole wave train, provided a consistent and reasonable definition of the rise time is used. In the present study the rise time was defined by the time required for the signal to build from 10% to 90% of its amplitude. The experimental parameters routinely determined were rise time, the velocity of sound through the foam, which is related to the arrival time of the signal and the area under the measured signal.

In a typical experiment, the tank was filled with a foam and the acoustic signal measured as a function of time (and thus for forms of different expansion ratios) and distance from speaker to microphone; each reading consisted of an average of 32 pulses. These measurements were compared with the unattenuated signal obtained in air to determine the energy losses from the acoustic signal as it passed through the foam.

For purposes of this exercise, it was considered that a satisfactory measure of attenution was the reciprocal, S, of the slope of the rise time versus speaker/microphone distance curve. The magnitude of the reciprocal slope decreases with increasing attenuation, and was found to be independent of speaker/microphone distance. For comparison, the rise time of the signal in air was measured as 25 microseconds and that in water was 15 microseconds.

FIG. 1 is a graph of observed values of S as a function of particulate solids content for the particulate foams, and indicates enhanced attenuation with increased particle loading.

Figure 2:
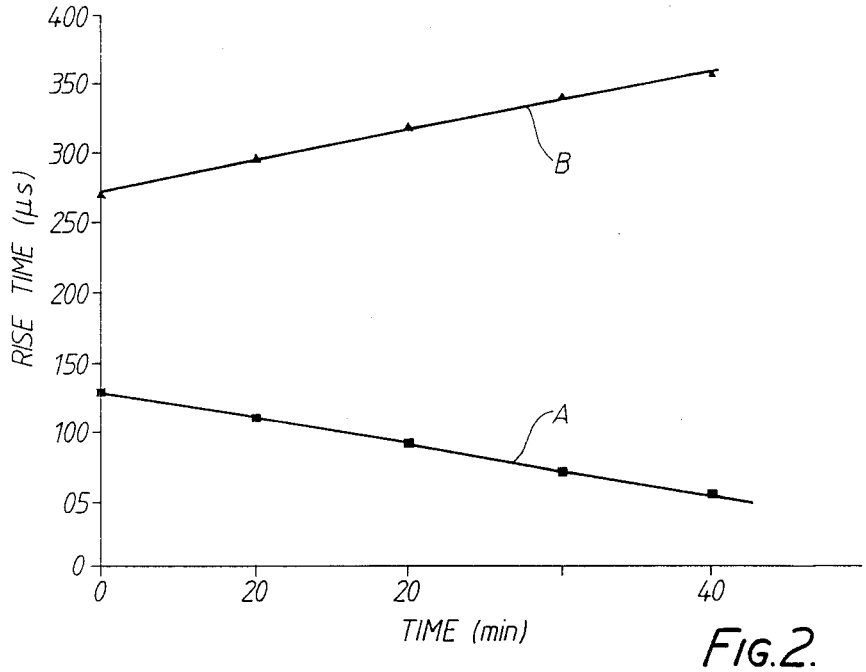

FIG. 2 is a further graph of rise time as a function of time (and therefore of expansion ratio) for the simple Type II foam (curve A) and for a 20% by weight particulate foam (curve B), commencing at the same initial expansion ratio. The upper curve B indicates that the attenuation characteristics of the particulate foam increased with drainage. This is in direct contrast to the observed behaviour of the simple foam (curve A) and is due to the particle loading of the foam effectively increasing with drainage (on a percent total weight basis), producing a similar effect to that shown in FIG. 1. The opposite behaviour of the conventional foam is thought to arise because the principal energy loss mechanism at lower expansion ratios is that due to the movement of liquid within the lamella region of the foam. A declining proportion of liquid thus diminishes energy absorption by this mechanism, but the effect is overridden with the particulate foams.

FIG. 2 also shows that the particulate foam was a far better attenuator of the acoustic signal than the corresponding simple foam. An initial consideration of the proposal would suggest that particles would increase the sound transmissivity of the foam, but the converse is observed. It is now thought that the enhanced attenuation might arise because the particulate dispersion increase the viscosity of the system, and therefore the viscous losses from the system. FIG. 1 supports this interpretation, as an increase in the proportional volume of particles in the liquid phase would be expected to likewise increase viscosity and viscous loss.

An advantageous application of liquid foam according to the invention is as a barrier of shock insulating material around an explosive charge used to blast rock, for example in mines. The foam is effective to reduce the extent of shattering adjacent to the site of the charge, by reducing the peak amplitude of the shock wave transmitted into the rock. More generally, the above results demonstrate that the shape of the pressure pulse produced by a high shock energy explosive can be significantly changed by the introduction of foam materials around the charge, and that the change is most marked with a particulate liquid foam. This will be of great benefit during the mining of coal where blasting in the coal seam occurs. Conventional blasting techniques can produce large quantities of fine material which is expensive and difficult to beneficiate. Considerable damage may also be caused to coal seams which significantly increases mining costs. Similar problems also occur in iron ore mining where lump ore commands a better price than fine material. Consequently, if the provision of a foam barrier technique allows an increase in the lump/fine ratio of ore produced without significantly altering the operating costs of a mine, an increase in profitability can be obtained.

This technique is also applicable in the final limits blasting of a mine where great care must be taken to ensure that the rock strata remaining are not damaged by blasting. The cushioning effect of foams will allow a closer match between explosive performance and the energy necessary to produce good fragmentation, while maintaining low interference with the remaining rock mass. The problems associated with over-drilling into coal seams may also be able to be reduced using this attenuation technique. For example, backfill in to the over-drilled section can be driven into coal seams by the detonating explosive. This can lead to the total loss of material or a large increase in mining and beneficiation costs.

Other significant applications of attenuating foam materials according to the invention include the reduction of the blast noise from military weapons, and the reduction of damage from car bombs and other terrorist devices.

COMPARATIVE EXAMPLE 3

In a further series of experiments model concrete block material was placed in the blast chamber employed in Example 1 for the purpose of studying fragmentation with and without protection by certain foam materials. A numbered 50×50 mm grid was marked (in different colors) on the top and front faces of the concrete blocks to enable large fragments emanating from these surfaces to be identified. Spall plates were fixed to the three remaining sides of the block as a means of artifically increasing the width and depth of the blocks with respect to the shock wave. The spall plates were made from concrete paving stones, 200×100×50 mm, and held in place by mortar which was coloured to allow fragments to be separated from those of the concrete block after the experiment. A hole was drilled in the block to a depth of 200 mm at a distance of 125 mm from the free (i.e. front) face, the diameter of the hole depending on the nature of the experiment. A second hole, 8 mm in diameter, was drilled 25 mm from the center of the first hole and a manganin gauge grouted into it, at a depth of 180 mm, using an epoxy/sand mixture. A known weight of explosive was attached to a detonator and the optical fiber triggering unit and placed in the bottom of the first hole. In cases where decoupled or foam attenuated charges were used the explosive/detonator/optical fiber assembly was placed in heat shrink tubing, positioned in the center of the hole and surrounded by the attenuating medium or air. A cardboard gasket was positioned around the top of the detonator to support the stemming. The blasthole was then stemmed with sand to a depth of 130 mm and the explosive detonated. Top detonation was necessary for these experiments due to difficulties with loading the explosive.

The ability of aqueous and solid foams to alter the fragment size distribution in model materials was determined using 6 g explosive and an 8 mm borehole with no packing and then a 25 mm borehole with air, vermiculite and Type II particulate foam. The results from these experiments are summarized in Table 2 and indicate that the fragmentation produced by an explosive can be significantly altered by the presence of foam attenuating materials placed around the charge. The best attenuation, of the two materials tested, was obtained with the Type II aqueous particulate foam, followed by vermiculite and then air. This is consistent with the results obtained in Example 1 and is a direct result of a reduction in the shock energy of the explosive as is evident from the stress gauge measurements. That is, as the shock energy of the explosive is reduced the percentage of coarse material produced by the explosive increases. In the present case, using concrete blocks, a majority of coarse fragments was produced due to the nature of the material being blasted. The effect in softer, more structured material is expected to even more pronounced.

TABLE 2

FRAGMENTATION RESULTS OBTAINED WITH A NUMBER OF FOAM MATERIALS IN CONCRETE BLOCKS

| | None (Fully Coupled) | Air | Vermiculite | Type II Foam |
|---|---|---|---|---|
| Parameter | | | | |
| Hole Diameter (mm) | 8 | 25 | 25 | 25 |
| No of Face Pieces | 44 | 19 | 13 | 11 |
| No of Top Pieces | 26 | 5 | 5 | 4 |
| Peak Stress (GPa) | 3.6 | 1.2 | 0.5 | 0.3 |
| Size Analysis (mm) | | | | |
| Wt % | | | | |
| +16 | 80.3 | 87.4 | 90.3 | 92.7 |
| −16 + 8 | 5.9 | 3.7 | 2.9 | 2.8 |
| −8 + 4 | 7.5 | 3.5 | 3.4 | 2.1 |
| −4 + 2 | 2.6 | 1.3 | 1.1 | 0.8 |
| −2 + 1 | 1.3 | 0.7 | 0.6 | 0.4 |
| −1 + 0.5 | 1.4 | 1.0 | 1.0 | 0.5 |
| −0.5 | 1.0 | 2.4 | 0.7 | 0.7 |
| Mass % Passing | | | | |
| +16 | 19.7 | 12.6 | 9.7 | 7.3 |
| −16 + 8 | 13.8 | 8.9 | 6.8 | 4.5 |
| −8 + 4 | 6.3 | 5.4 | 3.4 | 2.4 |
| −4 + 2 | 3.7 | 4.1 | 2.3 | 1.6 |
| −2 + 1 | 2.4 | 3.4 | 1.7 | 1.2 |

TABLE 2-continued

FRAGMENTATION RESULTS OBTAINED WITH A NUMBER OF FOAM MATERIALS IN CONCRETE BLOCKS

| | None (Fully Coupled) | Air | Vermiculite | Type II Foam |
|---|---|---|---|---|
| −1 + 0.5 | 1.0 | 2.4 | 0.7 | 0.7 |

The claims defining the invention are as follows:

1. A method for reducing the peak overpressure of an explosion produced by an explosive, comprising disposing adjacent to the explosive, or otherwise in the path of the shock wave of the explosion generated by the explosive, a barrier of an aqueous foam containing dispersion particulates, said dispersion particulates comprising particles predominately smaller than 200 mesh to enhance the sound attenuating capability of the aqueous foam without, substantially, destabilizing the foam.

2. The method according to claim 1 wherein said particulate is talc.

3. The method of claim 1 wherein the barrier of the aqueous has an initial expansion ratio which increases after an initial generation of the aqueous foam by virtue of drainage of aqueous from the liquid foam.

4. The method according to claim 3 wherein the expansion ratio of the foam increases from an initial generation of 40 to 200.

5. A method of mining utilizing an explosive to blast a geological structure, wherein the peak overpressure of an explosion produced by the explosive is reduced by disposing adjacent to the explosive, or otherwise in the path of the shock wave of the explosion generated by the explosive, a barrier of an aqueous foam containing dispersion particulates, said dispersion particulates comprising particles predominately smaller than 200 mesh, to enhance the sound attenuating capability of the aqueous foam without, substantially, destabilizing the foam.

6. The method according to claim 5 wherein said particulate is talc.

7. The method of claim 1 wherein the barrier of the aqueous foam has an intial expansion ratio which increases after an initial generation of the aqueous foam by virtue of drainage of liquid from the aqueous foam.

8. The method according to claim 7 wherein the expansion ratio of the foam increases from an initial generation of 40 to 200.

* * * * *

UNITED STATES PATENT AND TRADEMARK OFFICE

CERTIFICATE OF CORRECTION

PATENT NO. : 4,964,329

DATED : October 23, 1990

INVENTOR(S) : Neville T. MOXON et al.

It is certified that error appears in the above-identified patent and that said Letters Patent is hereby corrected as shown below:

On the title page, Item [75], change "Alstair C. Torrance" to --Alastair C. Torrance--.

Signed and Sealed this

Seventh Day of April, 1992

*Attest:*

HARRY F. MANBECK, JR.

*Attesting Officer*

*Commissioner of Patents and Trademarks*